US009126246B2

(12) United States Patent
Benedetti et al.

(10) Patent No.: US 9,126,246 B2
(45) Date of Patent: Sep. 8, 2015

(54) ROLLING METHOD FOR FLAT PRODUCTS AND RELATIVE ROLLING LINE

(75) Inventors: Gianpietro Benedetti, Tricesimo (IT); Paolo Bobig, San Canzian d'Isonzo (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 263 days.

(21) Appl. No.: 13/703,845

(22) PCT Filed: Jun. 14, 2011

(86) PCT No.: PCT/IB2011/001322

§ 371 (c)(1), (2), (4) Date: Feb. 27, 2013

(87) PCT Pub. No.: WO2011/158091

PCT Pub. Date: Dec. 22, 2011

(65) Prior Publication Data

US 2013/0145807 A1 Jun. 13, 2013

(30) Foreign Application Priority Data

Jun. 14, 2010 (IT) ..... UD2010A0115

(51) Int. Cl.
*B21B 1/06* (2006.01)
*B21B 1/26* (2006.01)
(Continued)

(52) U.S. Cl.
CPC . *B21B 1/06* (2013.01); *B21B 1/466* (2013.01); *B21B 1/26* (2013.01); *B21B 13/22* (2013.01);
(Continued)

(58) Field of Classification Search
CPC ..... B21B 1/06; B21B 1/14; B21B 1/26; B21B 1/32; B21B 1/34
USPC ..... 72/128, 200, 201, 229
See application file for complete search history.

(56) References Cited

U.S. PATENT DOCUMENTS

| | | | |
|---|---|---|---|
| 4,675,974 | A | 6/1987 | Connolly |
| 5,396,695 | A | 3/1995 | Ginzburg et al. |
| 6,182,490 | B1 | 2/2001 | Ginzburg et al. |

FOREIGN PATENT DOCUMENTS

| | | |
|---|---|---|
| CN | 1128182 | 8/1996 |

(Continued)

*Primary Examiner* — Teresa M Ekiert
(74) *Attorney, Agent, or Firm* — Hamre, Schumann, Mueller & Larson, P.C.

(57) ABSTRACT

Rolling method for the production of flat products, such as metal strip, which provides a production step of a thin slab with a thickness comprised between 30 and 90 mm, preferably between 35 and 70 mm, a temperature maintenance and/or possible heating step of the slab to be sent for rolling, and a rolling step with multiple passes performed in a reversing rolling mill (14) comprising at least a reversing rolling stand (15), in which at least a winding reel furnace (16*a*) is also present upstream of the stand (15) and a winding reel furnace (16*b*) downstream of the stand (15), a winding step also being provided downstream of the rolling in at least a coiler (19*a*, 19*b*) to form a relative coil of strip of a defined weight, comprised between 20 and 30 tons, and a cooling step of the strip being provided between the reversing rolling mill (14) and said at least one coiler (19*a*, 19*b*). The method provides that the thin slab is disposed, for example, sheared to size, upstream of the maintenance and/or possible heating step in order to form a segment of slab having a length equivalent, in weight, greater than that of a coil, and that, already after the first rolling pass in the reversing rolling mill (14), the thickness of the segment of slab is reduced to a value in the range of 20-25 mm so as to render it windable on the reel furnace (16*b*) downstream of the stand (15).

11 Claims, 4 Drawing Sheets

(51) Int. Cl.
*B21B 1/46* (2006.01)
*B21B 13/22* (2006.01)

(52) U.S. Cl.
CPC ..... *B21B 2261/04* (2013.01); *B21B 2261/12* (2013.01); *B21B 2261/18* (2013.01); *B21B 2265/14* (2013.01)

(56) References Cited

FOREIGN PATENT DOCUMENTS

| | | |
|---|---|---|
| CN | 1739872 | 3/2006 |
| EP | 0937512 | 8/1999 |
| JP | H 07-323324 | 12/1995 |

STATE OF THE ART

| | Conventional configuration casting thick slab, slab length equivalent to 1 coil (fig. 1) | Configuration casting thin slab, slab length equivalent to 1 coil | Configuration according to the present invention casting thin slab, slab length equivalent to 3 coils (figs. 2-5) |
|---|---|---|---|
| Slab thickness at inlet to rolling mill (mm) | 220 | 40-50 | 40-50 |
| Type of reversing rolling train | Two-stand Steckel | Two-stand Steckel | Two-stand Steckel |
| Rolling mode | Coil-to-coil | Coil-to-coil | Semi-endless |
| Annual production of mill (Mton/year) | 1.21 | .....1.50 | 1.71 |
| Increased productivity of mill | - | 100 | 123 |
| Minimum strip thickness obtainable (mm) | 1.6 | 1.4 | 1.2 |
| Temperature head-body-tail of strip (°C) | 790-920-810 | 800-920-890 | **1st strip**: 790-920-920<br>**2nd strip**: 920-920-920<br>**3rd strip**: 920-920-880 |
| Yield % (Ratio weight of coil/weight of slab) | 97.75 | 98.71 | 98.97 |

Comparative example with two-stand reversing Steckel fig. 6

ROLLING METHOD FOR FLAT PRODUCTS AND RELATIVE ROLLING LINE

FIELD OF THE INVENTION

The present invention concerns a rolling method and the relative line, for the production, in semi-endless mode of flat metal products, such as metal strip.

BACKGROUND OF THE INVENTION

Rolling lines are known for the production of metal strip starting from the continuous casting of slabs. Such lines normally provide a continuous casting, a heating and/or maintenance furnace, a possible cropping shear, a reversing or continuous rolling train, a cooling system and one or more winding units to form coils of the desired weight.

In particular, for example from U.S. Pat. No. 4,675,974, U.S. Pat. No. 5,396,695 and U.S. Pat. No. 6,182,490, a rolling line is known in which the continuously cast slab, after being sheared to size to produce a coil, is sent to the tunnel furnace, of a length at least equal to the segment of slab, which homogenizes the temperature, passing to a reduced speed, until the temperature is brought to suitable values for subsequent workings.

The segment of slab exiting from the tunnel furnace is accelerated and sent to the rolling unit.

It is known that rolling plants with a reversing rolling train of the Steckel type with one or more stands, an example of which is schematically shown in FIG. 1, use a slab with a thickness from 150 to 250 mm or more, and work with coil to coil mode, that is, with a length of slab which in relation to the thickness is equal in weight to a coil of finished product. In such plants there is a productivity limit, of a minimum final thickness, which in general is never less than 1.8-1.6 mm, and of a dimensional and surface quality of the strip: the productivity is limited by the high number of inversions and passes through the stand or stands, and by the connected downtimes; the final minimum thickness is limited by the great thickness of the slab at inlet; and the dimensional and surface quality is limited by the great difference in temperature between head/tail and the central part of the strip.

Moreover, the reversing Steckel rolling mill creates a problem connected to the fact that in the first rolling passes, the roughed slab, the so-called "transfer bar" or simply "bar", cannot normally be immediately wound in the reel furnaces disposed upstream and downstream of the stand, because of the great thickness of the entering slab, thus creating a problem of bulk of the line as the length of the slab increases.

Moreover, the great number of rolling passes, with consequent winding and unwinding in the reel furnaces placed upstream and downstream of the stand/stands, induces a cooling at the tip and the tail, as well as uneven temperatures along the coil which penalizes the yield because of the need to carry out head and tail cropping.

The high number of passes also determines variable dimensional tolerances in length and limitations in the production of thin thicknesses, and also rapid wear on the work rolls due to the high number of passes and the low temperature of the material being rolled and the leading/tail ends.

The entry of the cold and deformed leading ends into the furnaces upstream and downstream of the stand/stands is a delicate operation, with the risk of jamming, which becomes more and more probable with the reduction of the thickness of the strip.

One purpose of the present invention is to perfect a rolling method, and achieve a relative line, for the production of flat products in so-called semi-endless mode, which allows increase productivity, to increase the yield with respect to known plants and processes and which allows to obtain very thin thicknesses, from 1.0 to 2.0 mm, even as little as 0.8 mm.

Another purpose is to reduce the problem of jamming and blockages, in particular in the reel furnaces and in the coilers which form the final coil, even in the production of very thin thicknesses, below 2.0-2.5 mm, in any case maintaining high productivity and quality of the final product, irrespective of the type of steel cast.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with one feature, the present invention provides to feed the Steckel rolling train, with one or more stands, with a slab with a thin thickness comprised between 30 and 90 mm for example, preferably from 35 to 70 mm, advantageously but not necessarily starting from a continuous casting machine comprising at least a crystallizer.

In a non-restrictive form of embodiment, downstream of the crystallizer, the continuous casting provides a soft-reduction operation, that is, a reduction of the thickness cast with a liquid core, so that the thickness of the slab on entering the heating and/or maintenance furnace is in the range of 30-90 mm, preferably 35-70 mm.

In another non-restrictive form of embodiment, immediately downstream of the continuous casting machine there is a roughing or reduction unit, with one or more rolling stands, which reduces the thickness of the slab using the fact that the core of the slab, just solidified, is still very hot; the reduction unit allows to "modulate" the thickness of the slab, so as to have more stable and tranquil conditions for the casting in that it can cast a greater thickness at lower speed, with the same productivity. In this case too, the thickness of the slab entering the heating and/or maintenance furnace is in the range of 30-90 mm, preferably 35-70 mm.

The reduction or roughing unit can be provided irrespective of the presence or absence of the continuous casting machine upstream, therefore, in the case where the slabs are fed by different systems other than a continuous casting, for example by means of a discontinuous accumulation and storage system.

The method provides a temperature maintenance and/or possible heating step for the slab to be sent for rolling in the rolling train; the rolling train comprises at least one rolling stand of the reversing type (Steckel rolling mill), in which at least one winding reel furnace is also present upstream of the stand and one winding reel furnace downstream of the stand.

In one form of embodiment of the invention, there are two or more rolling stands of the reversing type.

The rolling line also comprises a shear for cutting to size, disposed downstream of the continuous casting, if present; the shear is able to cut the thin slab into segments of a desired length.

According to the present invention, the method provides that the thin slab entering the rolling mill has a length, equivalent in weight, higher than the biggest coil obtainable, which in general is in the range of 20-30 tons; preferably the length is equal to a finite multiple higher than 1 of the weight of the biggest coil obtainable.

The maintenance and/or possible heating furnace is a tunnel furnace able to contain the slab of a length, equivalent in weight to a finite number of coils, for example, but not only, from 2 to 7 or more, advantageously from 3 to 5.

In this way, the rolling line according to the present invention is suitable to work in so-called semi-endless mode, in which the segment of slab entering the rolling mill has a length equivalent in weight such as to form a variable number between 2 and 7 coils or more.

The solution of the present invention thus gives a first advantage in terms of productivity of the rolling mill, because down-times required for inversions of direction in the rolling mill are reduced: the reduction in times is equal to the number of coils made with a single slab. In other words, if with the slab entering the rolling mill it is possible to form, for example, 3 coils, the number of inversions in the rolling mill is reduce by a factor of 3 with respect to the coil-to-coil mode, that is, with respect to the case where the length of the slab corresponds to only one coil.

The times which elapse between two consecutive slabs during rolling are also reduced correspondingly, that is, by the same factor.

The use of a slab with a length corresponding to a finite multiple of coils also means that the cold leading and tail ends are only those that correspond to the first and last coil produced, so that all the intermediate coils do not need to be cropped and the overall yield is considerably increased.

A further advantage of the present invention is that, during the last rolling pass, the strip is simultaneously gripped between the winding reel furnace disposed upstream of the stand and the coiler which forms the coil: this in practice gives a situation of continuity during a large part of the last rolling pass. Consequently, since there is no leading end free, sliding on the roller-way toward the coiler, nor are there problems of entry of the thin strip, the compression force can be increased and the final thickness of the strip obtainable can be considerably reduced, to as little as 1.2-1.0 mm and less.

Advantageously, with a slab of a length equivalent in weight equal to 3 coils, 1 or 2 coils of thin thickness can be made, for example 1.0 mm, while with a slab of a length equivalent in weight equal to 4 coils, 2 or 3 coils can be made with a thinness, for example 1.0 mm. In any case it is provided that the two coils which correspond, respectively, to the leading section and to the tail section of the slab do not have a thin thickness. Therefore, in order to increase, with the same final weight, the number of coils with a thin thickness obtainable from one slab, it is necessary to reduce the weight of the leading and tail end coils.

The rolling line comprises, downstream of the rolling line and upstream of the coilers, a cooling unit of the shower type and a flying shear positioned immediately upstream of at least two coilers in order to shear the strip when the length has passed relative to each coil of the desired weight.

The coilers can also become three or more in relation to the length of the slab and above all, in relation to the desired number and weight of the individual coils obtainable starting from the same segment of slab.

In the case of a Steckel rolling mill with one stand, the thickness of the slab exiting from the tunnel furnace is preferably comprised between 35 and 50 mm, while in the case of a Steckel rolling mill with two stands the thickness is preferably comprised between 40 and 70 mm.

In some forms of embodiment, the line comprises a first de-scaler upstream of the reduction unit upstream of the furnace.

In further forms of embodiment, the line according to the present invention comprises a second de-scaler downstream of the heating and/or maintenance furnace.

BRIEF DESCRIPTION OF THE DRAWINGS

These and other characteristics of the present invention will become apparent from the following description of a preferential form of embodiment, given as a non-restrictive example with reference to the attached drawings wherein:

FIG. 6 shows a Table in which some characteristics and working parameters are compared of a conventional rolling line for thick slabs, such as the one in FIG. 1, of a rolling line for thin slabs in coil-to-coil mode, and of a rolling line for thin slabs in semi-endless mode according to the present invention.

DETAILED DESCRIPTION OF SOME PREFERENTIAL FORMS OF EMBODIMENT

Figure 2:
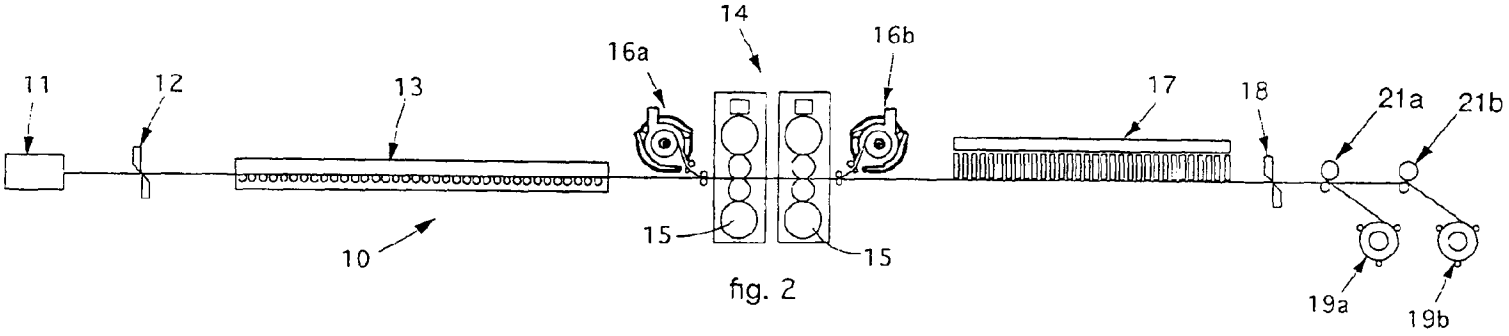
FIG. 2 shows schematically a first form of embodiment of a rolling line according to the invention.

With reference to the attached drawings, in which the same reference numbers correspond to equal or equivalent components, FIG. 2 shows a rolling line 10 for the production of strip starting from thin slabs. The rolling line 10 comprises, in this case, a continuous casting machine for thin slabs 11, a shear 12 for shearing the cast slabs to size, a tunnel furnace 13 for maintenance and/or possible heating, a reversing rolling mill 14 of the Steckel type with two (FIGS. 2 and 3) or one (FIGS. 4 and 5) rolling stand 15, with relative reel furnaces disposed upstream (16*a*) and downstream (16*b*) of the rolling stands 15, a cooling system 17, for example of the laminar shower type, a flying shear 18 and two coilers 19*a* and 19*b*, with associated relative drawing devices, or pinch-rolls 21*a* and 21*b*, in order to form the coil of strip of the desired weight.

Figure 3:
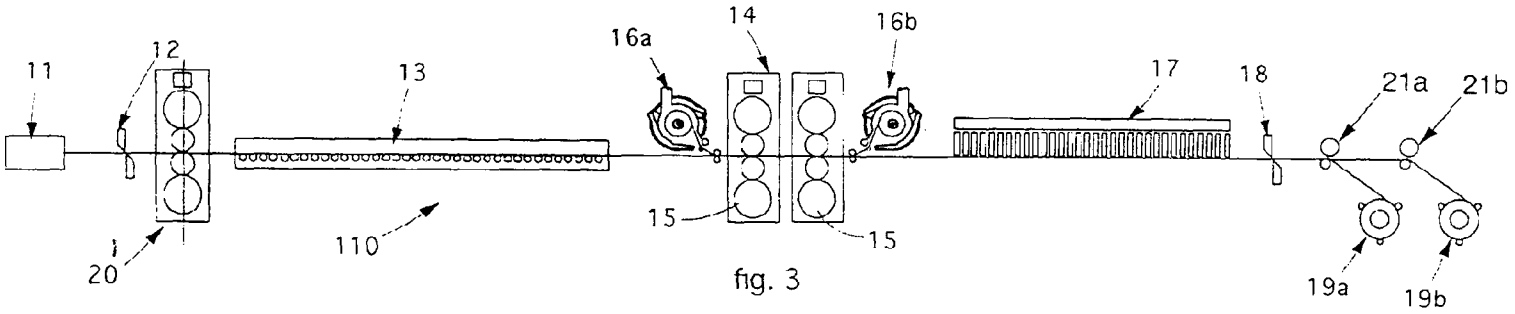
FIG. 3 shows schematically a first variant of FIG. 2.
Figure 4:
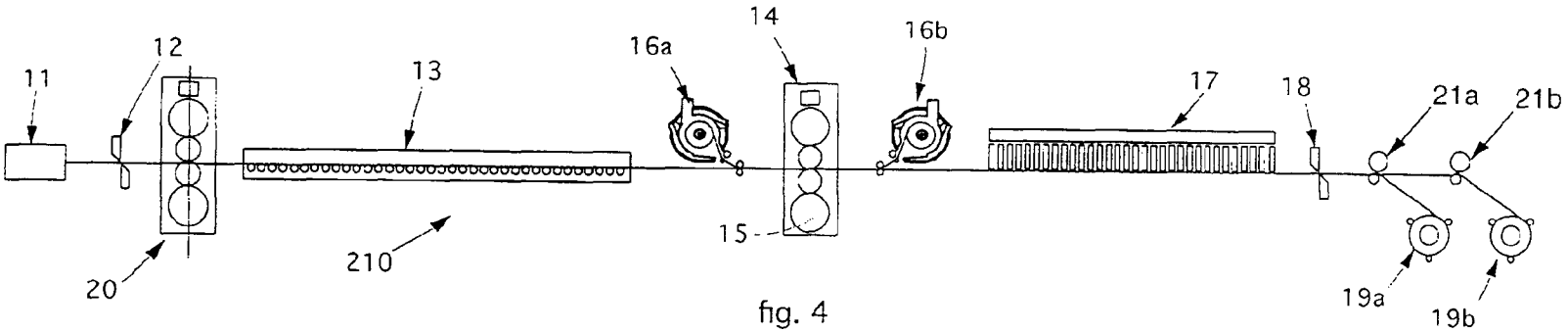
FIG. 4 shows schematically a second variant of FIG. 2.
Figure 5:
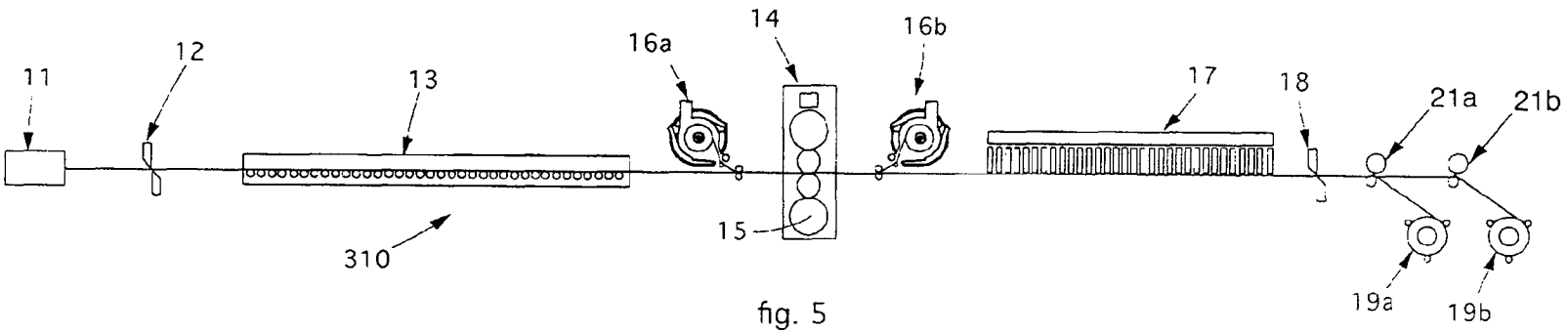
FIG. 5 shows schematically a third variant of FIG. 2.

The rolling line 110 in FIG. 3 differs from that in FIG. 2 in that it has a reduction or roughing unit 20, disposed upstream of the furnace 13, the line 210 in FIG. 4 differs from the others in that it has a rolling mill 14 with a single stand 15, while the line 310 in FIG. 5 differs from the line in FIG. 4 in that it does not have the reduction or roughing unit 20.

Other components of the lines normally present and known in the state of the art, such as de-scalers, trimmers, etc., are not shown in the attached drawings.

According to the present invention, in relation to the solutions shown in FIGS. 2-5, the shear 12 is disposed to shear segments of slab of a length equivalent in weight greater than the biggest coil obtainable which, in general, is in the range of 20-30 tons; preferably, the length is equal to a finite multiple higher than 1 of the weight of the biggest coil obtainable.

In other words, a segment of slab with a very long length in relation to the thickness, and corresponding to the weight needed to form 2, 3, 4, 5 or more coils of the maximum weight obtainable is fed to the furnace 13. In the case shown for example of a slab having a thickness equal to 70 mm, the length of the segment for forming 3 coils is equal to about 110 m, whilst in the case of a thickness equal to 35 mm, the length of the segment for forming 3 coils is equal to about 220 m.

The characteristic of the present invention is that the length of the slab after the first rolling pass is always greater than the length of the run-out table, that is of the roller-way comprised in the section between the exit of the last, or of the single, rolling stand 15 of the Steckel rolling mill 14 and the drawing device 21*a* associated to the first coiler 19*a*.

Therefore, according to the present invention, already after the first rolling pass in the Steckel rolling mill 14 the thickness of the segment of slab is reduced to a value, for example in the range of 20-25 mm, which makes it able to be rolled onto the reel furnace 16*b*, so as to avoid the problem, recurrent in the state of the art and which has so far rendered the use of the semi-endless mode impracticable in reversing Steckel-type rolling mills, of moving the long transfer bar flat on the run-out table for two or more passes through the rolling mill before being able to wind it in the reel furnaces 16*a*, 16*b*.

The main advantage of winding the bar in the reel furnace immediately after the first rolling pass is that the heat losses are contained, with the benefit of a smaller loss of temperature in absolute and a greater uniformity of temperature between leading/tail end and central part of the bar being rolled. This positively affects the dimensional and surface quality of the finished strip and also the possibility of obtaining thin thicknesses.

The rolling cycle is carried out in the reversing Steckel rolling mill 14 in a substantially traditional mode, with subsequent passes of unwinding from a first reel, rolling, and winding onto the second reel, until the desired thickness is obtained.

The reel furnaces 16*a*, 16*b* are suitably sized, in terms of capacity, heating capacity and strength, to contain the coil formed by the long and heavy transfer bar which is gradually formed as the rolling passes proceed in one direction and the other.

Having defined as De the maximum external diameter of the roll of transfer bar wound in the reel furnace and Di as the external diameter of the reel, we have in a conventional coil-to-coil process, the ratio De/Di is about 1.7-1.8, in any case it is less than 2;

in the semi-endless process according to the present invention, the ratio De/Di is greater than or equal to 2.

In the last pass, which defines the final thickness, the transfer bar is unwounded, in this case by the upstream reel furnace 16*a*, rolled in the stand or stands 15 of the Steckel and sent in the form of final strip toward the relative coiler 19*a* or 19*b*.

Advantageously, in this last pass, the strip is simultaneously gripped on the reel furnace 16*a*, on the stand or stands of the Steckel, and on the relative coiler 19*a*, 19*b*, so that for the whole length relative to the formation of at least 2, advantageously 3 or more, coils of finished strip, the rolling mill functions in endless mode, that is without any break in continuity between the rolling mill and the coiler.

Thanks to this, the force of compression of the rolls of the stand 15 can be increased, so that the thickness can be reduced to extremely low values, normally as little as to 1.0-1.2 mm, but even down to 0.8 mm, for a certain number of coils. Advantageously, the thickness between one coil and the next is changed so that the single coil has a constant thickness. This result can be obtained only through the semi-endless process shown heretofore.

When the winding of one coil of the desired weight is finished on a first coiler, for example 19*a*, is terminated, the flying shear 18 intervenes to divide the strip, after which the new leading end of the strip thus formed is diverted and the winding of the next coil is started, in this case on the coiler 19*b*.

In the case where the slab is able to form for example three or more coils, the cycle times are synchronized so that a first coil can be discharged in the time needed for the formation of the second coil, so that the first coiler is free for winding the third coil. On the other hand, three or more coilers can be present connected to respective diversion systems.

Figure 1:
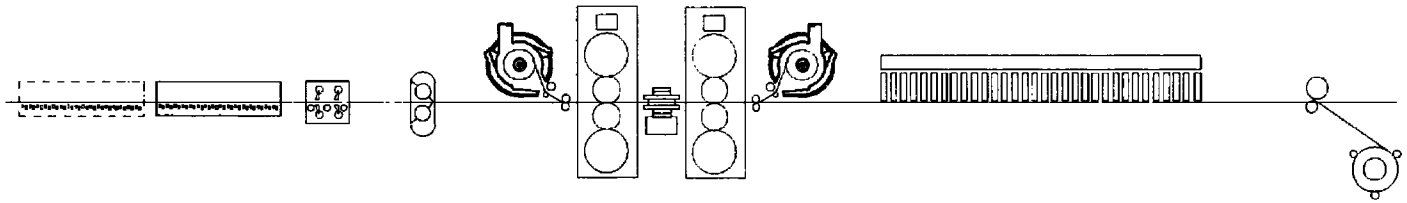
FIG. 1 shows schematically a rolling line according to the state of the art.

FIG. 6 shows a comparative Table, given as an example, comparing the performances of a conventional line with casting of thick slabs and coil-to-coil mode (for example of the type in FIG. 1), of a line with the casting of thin slabs and coil-to-coil rolling mode, and of a line with casting of thin slabs and semi-endless rolling mode according to the present invention. In all three cases a two-stand Steckel rolling mill is considered.

In particular, the Applicant has found that, with all the other conditions being equal, a semi-endless method and the relative line as described here allow, in the case of semi-endless with thin slab equal to 3 coils, to obtain an increase in productivity of the two-stand Steckel rolling mill equal to about 23% with respect to the case using a thin slab corresponding to the weight of a single coil (coil-to-coil mode).

More generally, each extra coil contained in the weight of the original thin slab increases the hourly productivity of the rolling mill by about 10-11%, because the cycle times are reduced by a corresponding amount, with corresponding increase in annual productivity.

Moreover there is an increase in overall yield because the losses of material due to the cropping of the leading and tail ends that do not meet the tolerances are reduced.

Finally, there is a considerable improvement in the surface and dimensional quality of the strip thanks to the fact that the semi-endless method according to the invention allows a smaller drop in temperature in absolute of the bar being rolled and also an increased uniformity of the temperature between leading/tail end and central part. As can be seen in the Table, in fact, the whole central part of the cast slab, which is used to form the strip, has a constant temperature from head to tail.

The invention claimed is:

1. A method for producing flat products, comprising providing a slab having a thickness from ~30 to ~90 mm;

shearing the slab into segmented slabs, wherein the segmented slabs have a same length and a same weight;

heating the segmented slab to a temperature;

maintaining the segmented slab at the temperature;

rolling the segmented slab in a reversing rolling mill for a plurality of passes to reduce a thickness of the segmented slab, the reversing rolling mill including at least one reversing rolling stand;

providing a first winding reel furnace upstream of the reverse rolling mill to wind the segmented slab, providing a second winding reel furnace downstream of the reverse rolling mill to wind the segmented slab, reducing the thickness of the segmented slab to about 20 to 25 mm immediately after a first pass in the reversing rolling mill;

winding the segmented slab on one of the winding reel furnaces immediately after the first pass in the reversing rolling mill;

forming a strip and defining a final thickness of the strip in a last pass of the segmented slab in the reversing rolling mill;

providing one coiler downstream of the second winding reel furnace, the coiler being configured to coil the strip to form a coiled strip, wherein a weight of the coiled strip is equal or less than the weight of a segmented slab;

providing a cooling process downstream of the reversing rolling mill and upstream of the coiler;

providing a shearing process downstream of the cooling process and upstream of the coiler;

gripping the strip simultaneously with the first winding reel furnace, the reverse rolling stand, and the coiler in the last pass of the segmented slab in the reversing rolling mill;

forming the coiled strip in a continuous manner immediately after the last pass of the segmented slab in the reversing rolling mill; and forming at least two coiled strips, wherein the weight of each coiled strip is from ~20 to ~30 tons.

2. The method as in claim 1, wherein the weight of the segmented slab is 2 to 7 times more than the weight of the coiled strip.

3. The method as in claim 1, wherein the weight of the segmented slab is 3 to 5 times more than the weight of the coiled strip.

4. The method as in claim 1, wherein the strip has a minimum thickness around 1.0 to 2.0 mm.

5. The method as in claim 1, wherein the slab is produced by a continuous casting machine.

6. The method as in claim 5, wherein the continuous casting machine provides a thickness reduction step with a liquid core.

7. The method as in claim 5, further comprising, providing a thickness reduction process immediately downstream of the continuous casting machine to reduce the thickness of the slab.

8. The method as in claim 1, wherein the slab is provided by an accumulation and storage system.

9. A rolling line for producing a strip, comprising a slab having a thickness from ~30 to ~90 mm;

a first shearing system for shearing the slab into a plurality of segmented slabs, each segmented slab having a same length and a same weight;

a heating system disposed downstream of the first shearing system, the heating system being configured to heat up a temperature of the segmented slab to a certain degree, the heating system has a length that is longer than the length of the segmented slab;

a first reel furnace disposed downstream of the heating system;

a reversing rolling mill disposed downstream of the first reel furnace, the reverse rolling mill being configured to include a reversing rolling stand, the reversing rolling mill being configured to roll the segmented slab for a plurality of passes to reduce its thickness, wherein a strip is formed from the segmented slab after a last pass defining a final thickness of the strip;

a second reel furnace disposed downstream of the reversing rolling mill;

a cooling system disposed downstream of the second reel furnace;

a second shearing system disposed downstream of the cooling system for shearing the strip; and a coiler disposed downstream of the second shearing system for coiling the strip into a coiled strip, wherein the coiled strip has a weight from ~20 to ~30 tons and the weight of the coiled strip is equal or less than the segmented slab;

wherein the rolling line is configured such that the segmented slab after a first pass in the reversing rolling mill has a length longer than a distance between the reversing rolling stand and the coiler, the strip has a length longer than a distance between the first reel furnace and the coiler, the strip is simultaneously gripped on the first reel furnace, the reversing rolling stand, and the coiler in the last pass of the segmented slab in the reversing rolling mill.

10. The rolling line as in claim 9, further comprising a continuous casting machine for producing the slab, a thickness reduction unit disposed downstream of the continuous casting machine and upstream of the first shearing system, the thickness reduction unit being configured to reduce the thickness of the slab to about ~30 to ~90 mm.

11. The rolling line as in claim 9, wherein the first and second winding reel furnaces have internal diameters equal or two times greater than an external diameter of a winded segmented slab.

* * * * *